US006683582B1

(12) United States Patent
Love

(10) Patent No.: US 6,683,582 B1
(45) Date of Patent: Jan. 27, 2004

(54) PHASED ARRAY ANTENNA USING A MOVABLE PHASE SHIFTER SYSTEM

(75) Inventor: Leo J. Love, Dallas, TX (US)

(73) Assignee: Leading Edge Antenna Development, Inc., Dallas, TX (US)

( * ) Notice: Subject to any disclaimer, the term of this patent is extended or adjusted under 35 U.S.C. 154(b) by 0 days.

(21) Appl. No.: 09/586,725

(22) Filed: Jun. 5, 2000

Related U.S. Application Data

(60) Provisional application No. 60/137,936, filed on Jun. 5, 1999.

(51) Int. Cl.[7] ..... H01Q 3/32; H01P 1/18

(52) U.S. Cl. ..... 343/853; 343/778; 333/160

(58) Field of Search ..... 333/156, 160, 333/161, 159; 343/853, 778

(56) References Cited

U.S. PATENT DOCUMENTS 4,616,195 A * 10/1986 Ward et al. ..... 333/160
6,097,267 A * 8/2000 Hampel ..... 333/161 X

* cited by examiner

*Primary Examiner*—Benny T. Lee
(74) *Attorney, Agent, or Firm*—Daniel J. Chalker; Edwin S. Flores; Chalker Flores, L.L.P.

(57) ABSTRACT

A phased array antenna is disclosed with a new method of phase shifting device when used with the cooperating antenna array feed system structure, yields an adjustable electrically directed radiated beam that may be actuated by means of a simple mechanical mechanism. The phase shift is accomplished by mechanically moving the phase shift coupling device upwards or downwards along the parallel feed body between adjacent feed lines in cavities within the antenna housing.

18 Claims, 2 Drawing Sheets

PHASED ARRAY ANTENNA USING A MOVABLE PHASE SHIFTER SYSTEM

This application claims priority to Provisional Patent Application, Ser. No. 60/137,936, filed Jun. 5, 1999.

TECHNICAL FIELD OF THE INVENTION

This invention relates to the field of antennas. More particularly, this invention relates to the method of electrically steering the radiated beam from the antenna array both for broadcast and receive antennae.

BACKGROUND OF THE INVENTION

In an ever more competitive environment it is desirable to manufacture an antenna with the ability to adjust the orientation of the radiated beam. Due to continued cost constraints it is desirable to produce antenna of the most simple design and greatest ease of manufacture. By the electrical steering of the radiated beam the antenna structure can remain fixed and not require physical reorientation. A fixed antenna is desirable as it is more simple to adjust the antenna by a central actuator for the reorientation of the radiated beam. A fixed antenna also lends itself to the remote operation of the central actuator so as to remove the need to be physically present for the reorientation of the antenna radiated beam.

Several approaches may be used to down-tilt the radiation pattern from an antenna. One involves actually tilting an entire antenna, but this method is too rigid an approach and is also costly. Another approach electrically down-tilts the pattern by adjusting the relative phases of the radiation associated with each of several elements of a multi-element antenna. Another electrical down-tilt method is a capacitive coupling method, in which an adjustable capacitance is placed in series with the transmission line feeding each element of the antenna array, thus causing the desired phase shifts. Another approach is to use different lengths of transmission lines for feeding the different elements; which produces a permanent electrical down-tilt. Yet another approach is to provide continuously adjustable down-tilting by mechanically varying the amount of dielectric material included in the transmission line, usually using a rack and pinion gear assembly.

Producing a fixed electrical phase shift, however, is too rigid an approach for many applications. A fixed electrical phase shift solution cannot be altered to fit ratio. Of the state-of-the art continuously variable electrical phase-shifting methods, the capacitive coupling method produces inter-modulation products, and is generally only good for omni-directional antenna patterns. Therefore, existing methods of providing continuous phase shifting, for example using a rack and pinion assembly, are mechanically complex, and so are often unreliable and expensive. The complexity in these methods stems from translating rotational to linear motion in moving dielectric into or out of the transmission line. It is generally known in the art that a receive antenna responds, and is directly related, to a radiation pattern broadcast by the antenna. Thus, the methods associated with down-tilting a broadcast antenna are applicable to adjusting a receive antenna to improve its reception in a particular direction.

SUMMARY OF THE INVENTION

The present invention is an antenna feed system which includes a cooperative phase shift coupling mechanism, antenna body housing and transmission line elbows, which allow for the continuously variable phase shift to the antenna array that electrically reorients the radiation pattern of the radiated beam. The present invention overcomes many of the shortcomings of prior art. Instead of loading the transmission line with dielectric material to slow the wave passing through the section, the present invention simply adjust the length of the line progressively to each of the elements in the array. Without the introduction of dielectric, the present invention is not limited to the associated mismatch and phase shift adjustment limits of the prior art. Though prior art is referenced, the present invention achieves similar results, is an entirely different method than those that use dielectric loading.

An antenna feed system which includes a cooperative phase shift coupling mechanism, antenna body housing and transmission line elbows according to the present invention is capable of continuously varying the orientation of the radiated beam of the radiation pattern associated with an antenna, the radiation pattern comprising an RF signal, the antenna having a plurality of elements and having an element terminal for each element and further having a feed system for communicating the RF signal between each element terminal and a common feed terminal. An antenna feed system according to the present invention includes a phase shift coupling mechanism which is used to distribute RF energy from the two ends of a branch of floating center conductor, which creates a transmission line when placed in the center of one of the many cavities formed in an extruded or other wise formed antenna body housing, to the center of the adjacent and continuing center conductor centrally located inside the adjacent and continuing cavity and continuing RF path, by means of quarter wave length coupling or other odd multiple of quarter wave or other coupling probe, which is placed in the center along the axis of the extruded or otherwise formed center conductor having a shape with an opening on a side parallel to the axis so that the center area of the shape is able to be reached and allow space for a rod or probe of some design, not actually making contact but of such length or shape as the electrical equivalent at the operating frequencies is such that the length of open circuited line inside of the continuing center conductor behaves as if the line is shorted or actually making contact at the point of entrance into the center conductor or another point. It is this electrically equivalent connection by means of the phase coupling device which allows the adjustment of the length of the RF path from the end of each branch lines to the center of, or above center of or below center of the adjacent and continuing RF line so that the path length from each of the individual ends of branches of the previous adjacent line to each of the two ends of branches or two antenna terminals at the ends of the center coupled or about center coupled continuing line is made adjustable in length when comparing the RF path length from the previous end branch to the continuing end branch or antenna terminal located above the coupling point to the other end branch or antenna terminal located below the same coupling point.

This process continues from each adjacent line in the corporate feed system until antenna terminals are connected or are in communication with the central feed point. As the central feed point will now be moving in cooperation with the floating lines so as to distribute the RF energy to each of the elements in a progressive or approximately progressive manner, a means is necessary to connect this moving point to a stationary position. This is accomplished through a series of transmission line elbows.

These elbows include a common ground plane and a suspended center conductor forming a transmission line by location above the ground plane. Each arm of the elbow unit couples energy to the next arm of the elbow unit by means of a quarter wave or odd multiple of quarter wave length or other coupling design tubular or similarly shaped conductors each of which are attached receptively to the previous and continuing arms placed in coaxial or similarly effective relationship, one inside or about the other, but not in physical contact so that they form an open circuited transmission line at the operating frequencies of the antenna one quarter wave or odd multiple thereof or other design or length such that equivalent electrical contact is made between the adjacent and continuing arms in the RF path, perpendicular to the arms away from the contact point or in other relationship to allow their relative movements.

The arms due to their shape at the contact intersection, and relative positions of the contact tubes are allowed to move axially about the center axis of each of the contact tubes thus enabling the dynamic RF connection between the floating feed line to the antenna and to the stationary input connector.

BRIEF DESCRIPTION OF DRAWINGS

The above features and advantages of the invention will become apparent from consideration of the subsequent detailed description presented in connection with accompanying drawings and sections thereof, in which.

DETAILED DESCRIPTION OF THE INVENTION

Figure 1:
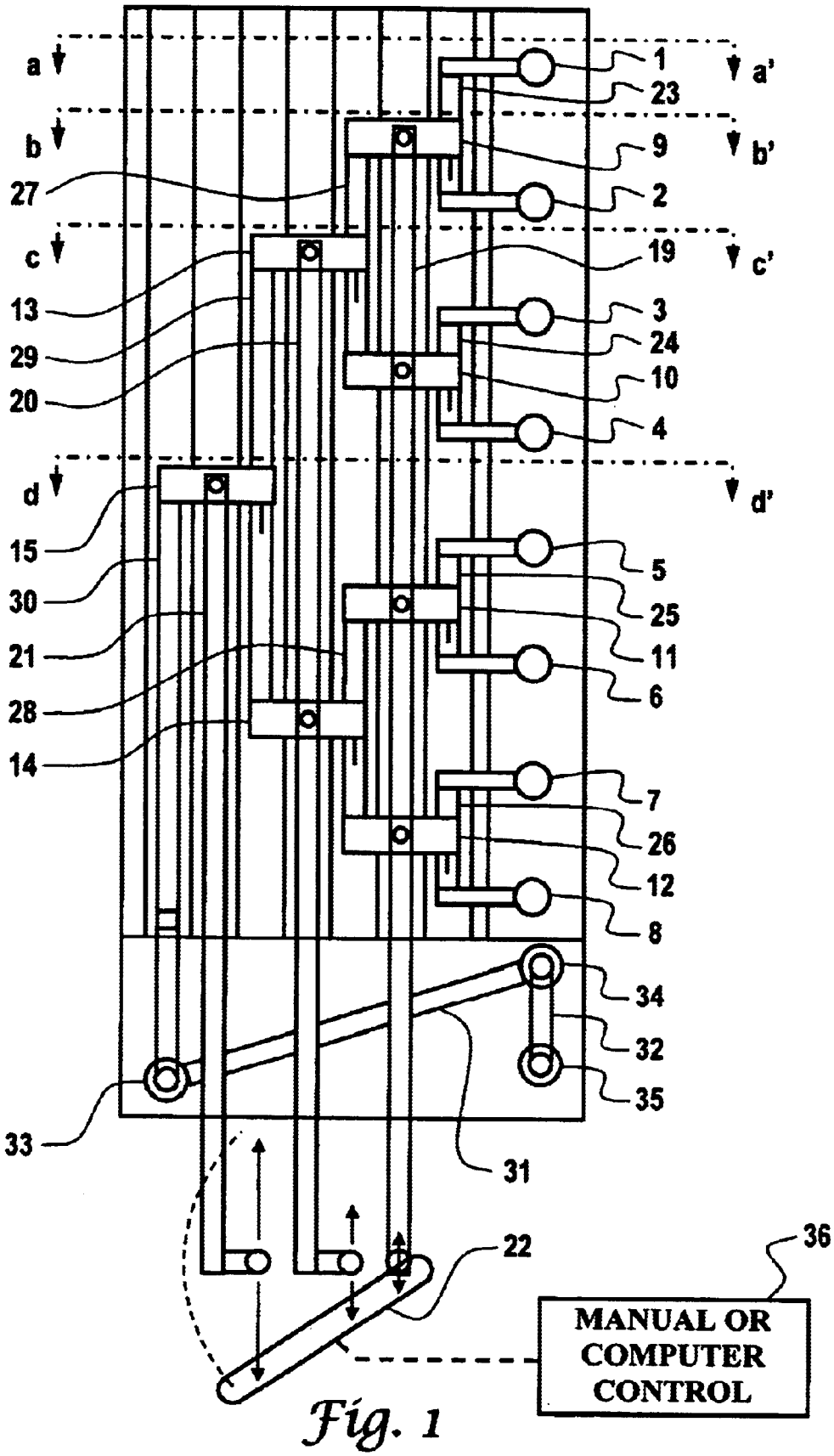
FIG. 1. Shows an embodiment of the present invention for an eight element array.

A phased array antenna with a new method of phase shifting device when used with the cooperating antenna array feed system structure, yields an adjustable electrically directed radiated beam which can be actuated by means of a simple mechanical mechanism. The phase shift is accomplished by means of moving the phase shift coupling device upwards or downwards along the parallel feed body between adjacent feed lines formed in the extruded body of the antenna structure.

The body of the antenna or additional structure is composed of an extruded or otherwise formed shape so that parallel cavities are formed which make up the outer conductor of an air line coaxial feed system. Each of these cavities have openings approximately equal to the diameter of the center conductor when placed in the center of the opening would form a transmission line of 50 ohm impedance. Each of these openings face upwards away from what is commonly known as the back reflector of the antenna array. In a corporate feed system each of the adjacent lines form the lines necessary to feed each of the radiating elements equally as determined from the input connection.

In an eight element array for example the cavity or outer conductor adjacent to the radiating elements will join 4 groups of two element each by the connection of the element center conductors of each element to the center conductor running inside the cavity between the 4 groups of two elements. Continuing the next phase shift device will couple energy from the center of the 4 groups of two to form 2 groups of four and so on to the next line to join the upper 4 elements to the lower 4 elements. The described center conductor lines and their accompanying phase shift coupling device all move in unison in such a relationship to create a linear phase taper across all radiating elements in the array. The movement of these lines can be accomplished in one of several ways one of which may be by a lever placed in perpendicular relationship to the parallel feed lines and attached to mechanical arms that attach themselves to each group of phase shifting devices.

Figure 2A:
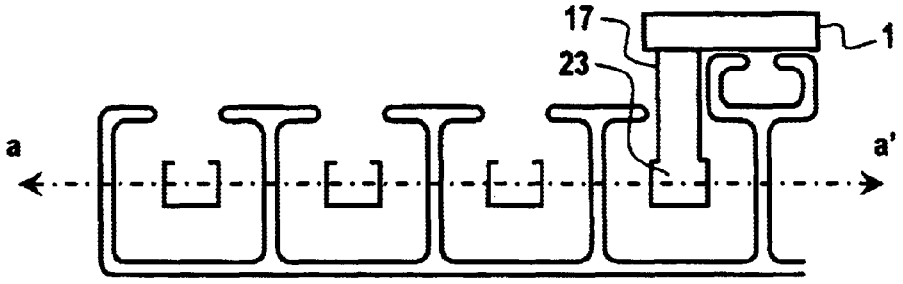
FIGS. 2A, 2B, 2C and 2D are cross-sectional views along the lines shown in FIG. 1 and are sectional detailed views of the various positioned phase shift mechanism.
Figure 2B:
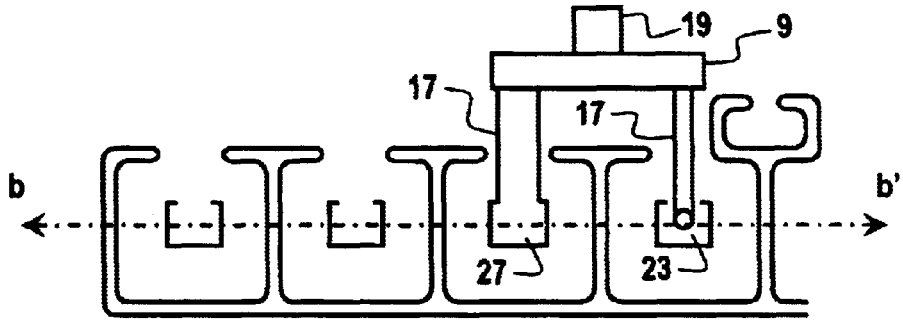

Referring now to FIG. 1 a phase shift mechanism 9, is located between the first and second element terminals 1 and 2 as numbered from the top of FIG. 1. The radiating elements are connected to radiating element terminals 1, 2, 3, 4, 5, 6, 7 and 8. The phase shift mechanisms 9, 10, 11, 12 are free to move vertically in parallel to the longer length of the antenna body. Referring to both FIG. 1 in conjunction with FIGS. 2A, 2B, 2C and 2D, cross section lines a–a' (FIG. 2A), b–b' (FIG. 2B), c–c' (FIG. 2C) and d–d' (FIG. 2D) of FIG. 1 are depicted. As shown in FIGS. 2A, 2B, 2C and 2D, a coupling probe 17 is found on every phase shift mechanism, e.g., phase shift mechanism 9. As shown in FIG. 2B, phase shift mechanism 9 is free to move in relation to the fixed center conductor line 23 connecting first and second element terminal 1 and 2 previously described. An antenna feed system according to the present invention includes a phase shift coupling mechanism 9 that is used to distribute RF energy via the coupling probe 17.

Phase shift mechanism 10, 11, and 12 are all generally free to move in the same manner, relative to the antenna elements above and below their location and phase shift mechanisms 10, 11, and 12, which may all be connected in unison with phase shift mechanism 9 by mechanical arm 19. Mechanical arm 19 may be connected at any location along its length to a lever 22 to move the phase shift mechanisms 9, 10, 11, 12 to adjust the phase relationship between the antenna elements. Likewise, one of skill in the art will appreciate, based on the present disclosure, that adjacent mechanical arms 20 and 21 may also be connected to the same or different levers to adjust the phase shift between feed lines. The feed lines 23, 24, 25, 26, 27, 28, 29 and 30 distribute the RF energy from the coupling points to the ends of elements of the next phase shift mechanism. See also FIGS. 2B, 2C and 2D. The lever arm 22 will cause the shift of the mechanical arms to control the phase shift and is under the control of a motor (not depicted). The lever may be moved by a computer controlled motor or manually adjusted as depicted by manual or computer control 36.

Transmission line arms 31 and 32 connect at transmission line elbows 33, 34 and 35 to translate the moving center conductor 30 to a stationary input at elbow 35. The transmission line elbows 33, 34 and 35 allow rotation to maintain electrical conductance during the movement of center conductor 30. Transmission line elbow 35 provides a fixed contact for an RF input/output.

Figure 2C:
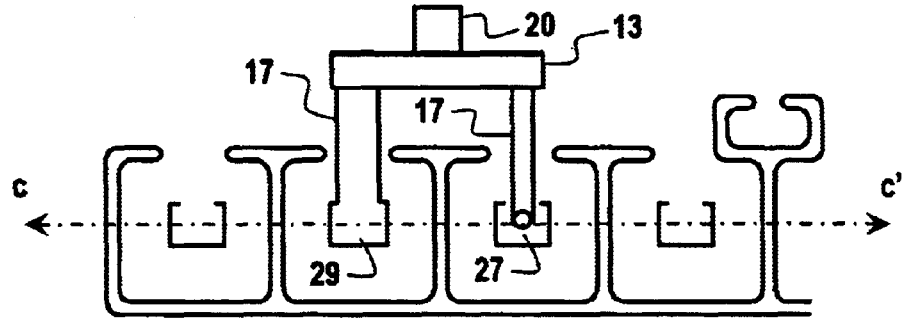
Figure 2D:
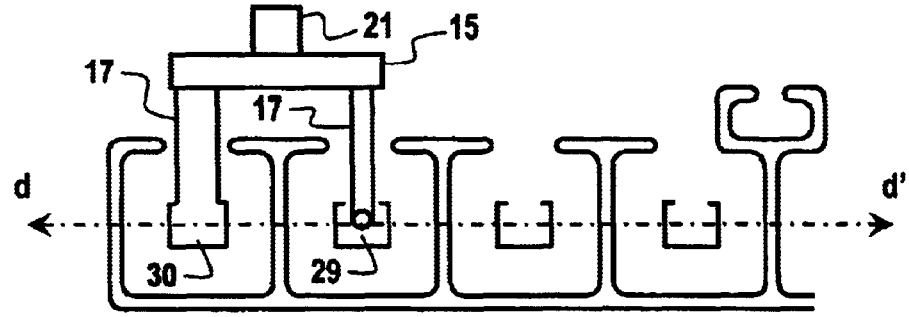

In continuation of the RF path within the antenna phase shift mechanism 13 is located between the ends of floating center conductor ends which are connected to phase shift mechanism 9 and 10. As shown in FIG. 2C, phase shift mechanism 13 is free to move in relation to feed line 27 (floating center conductor). Also phase shift mechanism 14 is located between the ends of floating center conductor which are connected to phase shift mechanism 11 and 12. Phase shift mechanisms 13 and 14 can be mechanically joined in unison by mechanical arm 20. Vertical movement is allowed parallel to the antenna body. Continuing on in the RF path within the antenna phase shift mechanism 15 is located between the ends of floating center conductor ends which are connected to phase shift mechanisms 13 and 14. As shown in FIG. 2D, phase shift mechanism 15 is free to move in relation to feed line 29 (floating center conductor). Phase shift mechanism 15 can be attached to mechanical arm 21. Phase shift mechanism 15 is free to move parallel to the antenna body. Transmission line elbows 33, 34, and 35 allow the RF connection between floating center conductor and the stationary input terminal of the antenna.

The phase shifter of the present invention may be used in antennas with many different types of radiating elements and may be used to tilt the radiation patterns of either uni-directional or omni-directional antennas. Although one embodiment uses one or more phase shift mechanisms, the present invention is not limited to using any number of phase shift mechanisms, and is not limited to use with an antenna having eight elements. In addition, this arrangement for continuously varying the phase shift of an antenna element may be used in an antenna system using a feed system that is series, binary, or any combination of series and binary feed systems. Although in between the radiating elements in the antenna array, the phase shifting mechanism may be varied to produce other kinds of relationship.

It is to be understood that the embodiments described herein are merely illustrative of the many possible specific arrangements that can be devised in application of the principles of the invention. Other arrangements may be devised in accordance with these principles by those of ordinary skill in the art without departing from the scope and spirit of the invention. It is therefore intended that such other arrangements be included within the scope of the following claims and their equivalents.

What is claimed is:

1. An antenna comprising:

an antenna body having a first cavity, a second cavity a third cavity and a fourth cavity;

a first, second, third and fourth group of element terminals, each group of element terminals comprising a respective first element terminal and a corresponding second element terminal adjacent to the first cavity;

each group of element terminals having a respective fixed center conductor located coaxially within the first cavity and connecting the first element terminal to the second element terminal of the corresponding group of element terminal;

a first floating center conductor having first and second ends located coaxially within the second cavity;

a first moveable phase shift mechanism coupled to the first end of the first floating center conductor and moveably coupled to the fixed center conductor of the first group of element terminals;

a second moveable phase shift mechanism coupled to the second end of the first floating center conductor and moveably coupled to the fixed center conductor of the second group of element terminals;

a second floating center conductor having first and second ends located coaxially within the second cavity;

a third moveable phase shift mechanism coupled to the first end of the second floating center conductor and moveably coupled to the fixed center conductor of the third group of element terminals;

a fourth moveable phase shift mechanism coupled to the second end of the second floating center conductor and moveably coupled to the fixed center conductor of the fourth group of element terminals;

a third floating center conductor having first and second ends located coaxially within the third cavity;

a fifth moveable phase shift mechanism coupled to the first end of the third floating center conductor and coupled to the first floating center conductor between the first and second ends of the first floating center conductor;

a sixth moveable phase shift mechanism coupled to the second end of the third floating center conductor and coupled to the second center conductor between the first and second ends of the second floating center conductor;

a fourth floating center conductor having first and second ends located coaxially within the fourth cavity; and a seventh moveable phase shift mechanism coupled to the first end of the fourth floating center conductor and coupled to the third floating center conductor between the first and second ends of the third floating center conductor.

2. The antenna as recited in claim 1, further comprising:

a first mechanical arm connected to the first, second, third and fourth moveable phase shift mechanisms to control the movement of the first, second, third and fourth moveable phase shift mechanisms;

a second mechanical arm connected to the fifth and sixth moveable phase shift mechanisms to control the movement of the fifth and sixth moveable phase shift mechanisms; and a third mechanical arm connected to the seventh moveable phase shift mechanism to control the movement of the seventh moveable phase shift mechanism.

3. An antenna comprising:

an antenna body having a first cavity, a second cavity and a third cavity;

a first and second group of element terminals, each group of element terminals comprising a respective first element terminal and a corresponding second element terminal adjacent to the first cavity;

each group of element terminals having a respective fixed center conductor located coaxially within the first cavity and connecting the first element terminal to the second element terminal of the corresponding group of element terminals;

a first floating center conductor having first and second ends located coaxially within the second cavity;

a first moveable phase shift mechanism coupled to the first end of the first floating center conductor and moveably coupled to the fixed center conductor of the first group of element terminals;

a second moveable phase shift mechanism coupled to the second end of the first floating center conductor and moveably coupled to the fixed center conductor of the second group of element terminals;

a second floating center conductor having first and second ends located coaxially within the third cavity; and a third moveable phase shift mechanism coupled to the first end of the second floating center conductor and coupled to the first floating center conductor between the first and second ends of the first floating center conductor.

4. The antenna as recited in claim 3 wherein each moveable phase shift mechanism is coupled to the respective floating center conductor and the respective fixed center conductor of the corresponding group of element terminals by respective coupling probes.

5. The antenna as recited in claim 4 wherein the coupling probes are positioned coaxially in the center of the respective cavities.

6. The antenna as recited in claim 4 wherein the coupling probes are electrically isolated from each fixed center conductor and each floating center conductor.

7. The antenna as recited in claim 3 further comprising:

a first mechanical arm connected to the first and second moveable phase shift mechanisms to control the movement of the first and second moveable phase shift mechanisms; and a second mechanical arm connected to the third moveable phase shift mechanism to control the movement of the third moveable phase shift mechanism.

8. The antenna as recited in claim 7 wherein the first and second mechanical arms are computer controlled.

9. An apparatus for varying a phase shift between a first element terminal and a second element terminal in an antenna comprising:

an antenna body having a first cavity and a second cavity;

the first element terminal and the second element terminal adjacent to the first cavity;

a fixed center conductor located coaxially within the first cavity and connecting the first element terminal to the second element terminal;

a floating center conductor having first and second ends located coaxially within the second cavity; and a phase shift mechanism coupled to the first end of the floating center conductor and moveably coupled to the fixed center conductor such that the phase shift between the first element terminal and the second element terminal is varied by moving the phase shift mechanism along the fixed center conductor relative to the first element terminal and the second element terminal.

10. The apparatus as recited in claim 9 wherein the phase shift mechanism is coupled to the floating center conductor and the fixed center conductor by coupling probes.

11. The apparatus as recited in claim 10 wherein the coupling probes are electrically isolated from the fixed center conductor and the floating center conductor.

12. The apparatus as recited in claim 10 wherein the coupling probes are positioned coaxially in the center of the respective cavities.

13. The apparatus as recited in claim 9 wherein the antenna body is extruded.

14. The apparatus as recited in claim 9 wherein the fixed center conductor and the floating center conductor are formed as an extrusion.

15. The apparatus as recited in claim 9, further comprising a mechanical arm connected to the phase shift mechanism to control the movement of the phase shift mechanism.

16. The apparatus as recited in claim 15 wherein the mechanical arm is computer controlled.

17. The apparatus as recited in claim 9 wherein the phase shift mechanism creates a branch point.

18. The apparatus as recited in claim 9 wherein the phase shift mechanism creates an RF path.

* * * * *